United States Patent [19]

Hofmann et al.

[11] 4,361,286

[45] Nov. 30, 1982

[54] FUEL INJECTION NOZZLE FOR INTERNAL COMBUSTION ENGINES

[75] Inventors: Karl Hofmann, Remseck; Kurt Seifert, Esslingen-Zollberg, both of Fed. Rep. of Germany

[73] Assignee: Robert Bosch GmbH, Stuttgart, Fed. Rep. of Germany

[21] Appl. No.: 215,471

[22] Filed: Dec. 11, 1980

[30] Foreign Application Priority Data

Dec. 11, 1979 [DE] Fed. Rep. of Germany ..... 2949655

[51] Int. Cl.[3] ..... F02M 61/16; F02M 61/08

[52] U.S. Cl. ..... 239/453; 285/401; 403/348

[58] Field of Search ..... 403/348; 285/307, 376, 285/401; 239/453, 456, 459, 452, 533.12

[56] References Cited

U.S. PATENT DOCUMENTS 2,753,217 7/1956 Pecora, Jr. et al. ..... 239/453

3,690,566 9/1972 Krauss et al. ..... 239/453

*Primary Examiner*—Andres Kashnikow

*Attorney, Agent, or Firm*—Edwin E. Greigg

[57] ABSTRACT

A fuel injection nozzle having a valve needle opening outward is proposed in which the valve needle is suspended in place in the base of a spring plate embodied in the form of a cup.

2 Claims, 4 Drawing Figures

FUEL INJECTION NOZZLE FOR INTERNAL COMBUSTION ENGINES

BACKGROUND OF THE INVENTION

The invention is based on a fuel injection nozzle having a valve needle guided in the bore of a nozzle body and subject to a closing spring, the head of the needle being machined for suspension in a spring plate having an oblong recess. In known fuel injection nozzles of this kind, the oblong recess is embodied in the form of a keyhole, so that the valve needle head, after being suspended in place, rests on an area having about 270° of the circumference. This lack of support can cause unilateral twisting and accordingly an improper placement of the valve needle. In other known fuel injection nozzles, the spring plate is embodied in two parts and held together by a ring disposed pointing toward the spring. This embodiment does assure uniform stress on the valve needle; however, it is too expensive to manufacture. In addition, in fuel injection nozzles of this kind in which the valve needle is guided in the nozzle body, the intention is to keep the guided section as short as possible, so that it is necessary to perform precise finishing of the bore by working from one end only. In other words, beyond a certain length of bore, the precise finishing must be done by working from both ends, which has the disadvantage that re-chucking is necessary, which is expensive in terms of both lost time and added cost, and the further disadvantage that the two parts of the bore may not be absolutely aligned with one another. In known fuel injection nozzles of the type described at the outset, in which only a relatively short section of the needle is guided, the needle still must be guided up to the end of the spring, in order to be suspended in place in a spring plate at that point. Unilateral forces of the spring thus cause torsional stress to be exerted upon the valve needle, which can cause seizing and attendant problems in the injection process.

OBJECT AND SUMMARY OF THE INVENTION

The fuel injection nozzle according to the invention has as its principal object attainment of a uniform transmission of force to the valve needle from the closing spring.

A further object is to provide a valve needle whose manufacture is at a cost-effective level.

In accordance with a preferred embodiment of the invention, the valve needle protrudes outwardly from the nozzle body only around the section which is required for the purpose of suspension in place. The length of the nozzle body is no longer than that which is necessary to guide the valve needle effectively.

The invention will be better understood and further objects and advantages thereof will become more apparent from the ensuing detailed description of a preferred embodiment taken in conjunction with the drawings.

BRIEF DESCRIPTION OF THE DRAWINGS

A preferred embodiment of the fuel injection nozzle of the invention is shown, in two variants, in the drawings, in which.

DESCRIPTION OF THE PREFERRED EMBODIMENT

Figure 1:
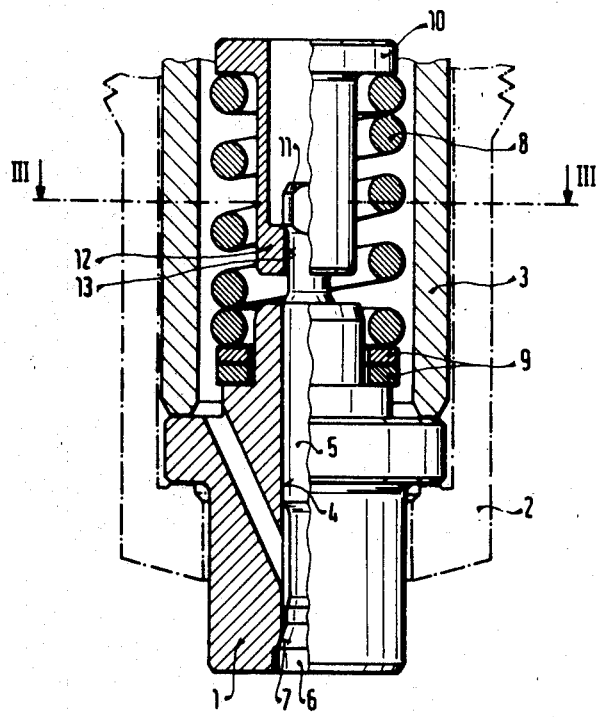
FIG. 1 shows in partial longitudinal section a fuel injection nozzle having a valve needle opening outward.

In FIG. 1, part of the fuel injection nozzle is shown in an exterior view, and part is shown in longitudinal cutaway fashion, so as to provide an understanding of the structural relationships. A nozzle body 1 is held against a nozzle holder 3 by a sleeve nut 2 indicated by dot-dash lines. A valve needle 5 operates within a central bore 4 of the nozzle body 1, opening outward. On the injection side, the valve needle 5 has a head 6, which cooperates with a valve seat 7 disposed on the nozzle body 1. The needle head 6 is held against the valve seat 7 by a closing spring 8, which is supported on one end on the nozzle body 1, via two shims 9 which are supported by a shoulder on the upper end of nozzle 1, and on the other end in abutment with a shouldered spring plate 10.

The spring plate 10 has a bored neck portion which is coupled to the valve needle 5 via a base 12 which extends into the spring 8. The coupling of spring plate and valve needle is achieved by another head 11 provided on the opposite extremity of the valve needle 5 which is suspended in a recess 18 which is disposed in the base 12 of the spring plate 10.

Figure 2:
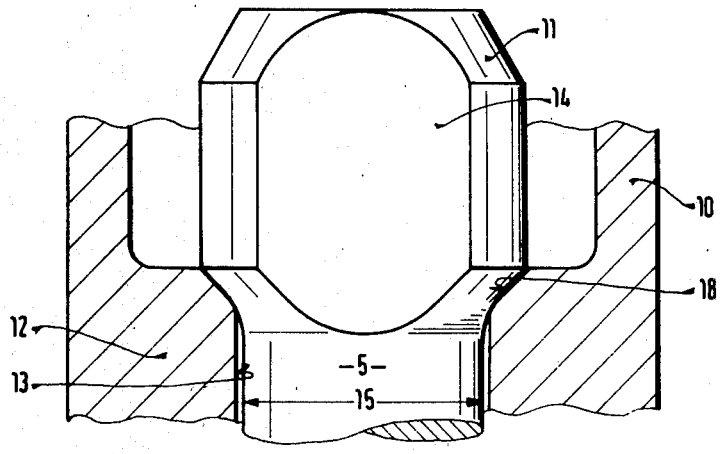
FIG. 2 is a longitudinal section through the coupling portion between the valve needle and the spring plate, on a larger scale.

Turning now to FIG. 2, which is a detail enlargement of FIG. 1, the coupling between the spring plate 10 and the valve needle 5 is shown on a larger scale but in the same position as that shown in FIG. 1. The head 11 of the valve needle 5 is of a greater diameter than that of its neck portion and is provided with a tapered surface, which taper extends from the neck portion to the outer diameter of the head. The head is machined to provide axially extending parallel flat surfaces 14 which are cut tangent to the neck portion of the valve needle 5 so that the thickness of the head portion between the parallel cut surfaces is the same as the diameter of the neck portion. The portion of the head not cut to form the flat surfaces tapers (as may best be seen from FIG. 3) to the diameter 15 of the neck portion of the valve needle 5. The bottom of the base in the spring plate is provided with an axially extending passage 13 having parallel flat wall surfaces or areas 16 which are rounded at their ends. The spacing between the parallel surfaces is slightly greater than that of the shaft portion of the valve needle 5. The recess 18 in the base of the spring plate has the same shaped configuration as that of the taper of the head portion and the parallel machined sides 14 of the head so that the head of the valve needle fits within the recess. The flat sides 16 of the recess 18 extend perpendicular to the flat surfaces of the passage 13 as shown in FIG. 3.

Figure 3:
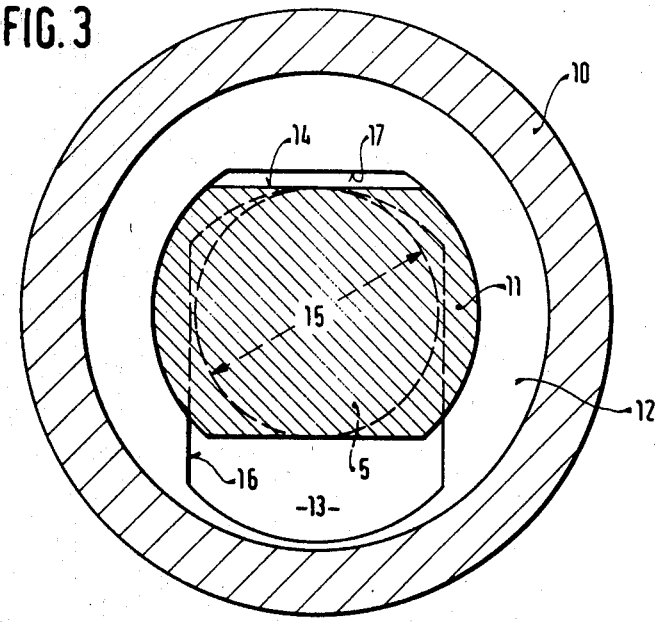
FIG. 3 is a cross section of the first variant shown in FIG. 1.
Figure 4:
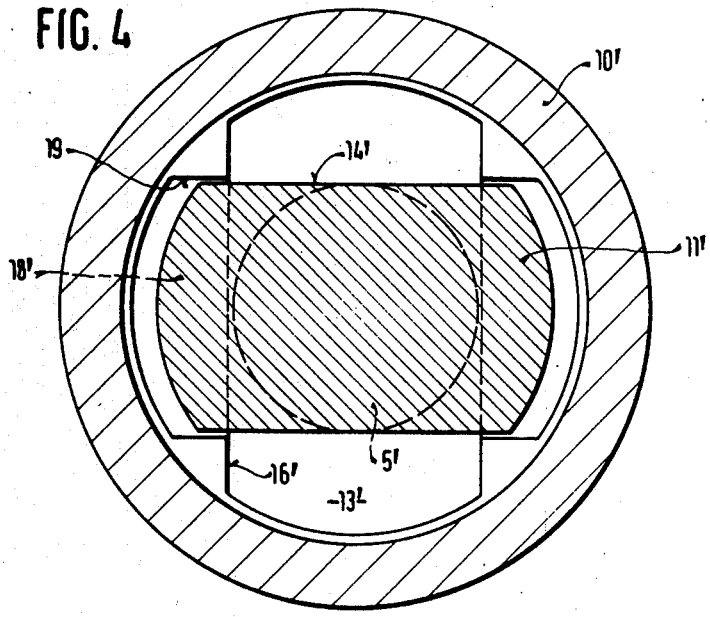
FIG. 4 is a cross section through the second variant.

FIGS. 3 and 4 each show one section through the spring plate 10, taken along the line III—III of FIG. 1 (in FIG. 4, corresponding reference numerals are provided with a prime). To perform the coupling of the needle and the plate, the head 11 of the valve needle 5 is pushed through the passage 13 in the spring plate, in such a way that the flat machined areas 14 extend parallel to flattened areas 16 of the keyhole. After the valve needle 5 has been pushed through, it is rotated by 90°, so that the head 11 assumes the position shown in the drawings.

In the first variant shown in FIG. 3, the passage 13 is disposed eccentrically within the spring plate 10, and upon being rotated to a complemental position, the head of the valve needle 5 is inserted within the passage 13 and then moved into a true axial position which is central relative to the spring plate 10. After this has been done, one of the flat machined areas 14 assumes a position parallel to one flattened area 17 on one of the short sides of the passage 13. This flattened area 17 and the recesses 18 (best shown in FIG. 2) provided in the wall of the spring plate 10 at the locations which are in contact with the head 11 assure that the valve needle 5 will not twist about and possibly become uncoupled.

In the variant shown in FIG. 4, the passage 13' is symmetrical to two planes extending through the center axis of the spring plate 10', which are perpendicular to one another, so that after being pushed into place centrally and then rotated the valve needle 5' is locked into position. The recesses 18' are defined by the opposed straight faces 19 disposed to receive the flattened areas 14'; these faces 19 assure that the needle head 11' will not twist out of position in the recess 13' after being suspended in place.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines including a nozzle body having an inner bore, a valve needle including a body portion whose major length portion is guided in the inner bore of said nozzle body, said valve needle including a headed area and a contiguous neck portion, said nozzle body having a shoulder area, a compression spring member supported on one end by said shoulder area, a spring plate element including a shouldered end positioned in abutment with another end of said spring member, said spring plate element having an elongated dependent cup shaped body that extends from said shouldered end coaxially into said spring member along a major portion of the length of said spring member and terminates in a base, provided with an oblong recess passage through which said headed area of said valve needle extends, a recess in said base in which said headed area having a tapered portion extending from said neck portion to the outer dimension of said head seats, said recess including at least one straight side wall with upwardly tapered walls, characterized in that said headed area of said valve needle further includes oppositely disposed flattened face portions which lie in planes that are coplanar with said neck portion of said valve needle, said flattened face portions arranged to be introduced through said oblong passage in said base of said spring plate and rotated 90° to lock the valve needle in said recess in the base of said spring plate element under influence of said spring member.

2. A fuel injection nozzle as claimed in claim 1, wherein said passage in said base is offset relative to the axial center thereof and upon insertion of said headed valve needle through said passage and rotating the same 90° one of said flattened face portions is brought into close proximity to a complementally formed wall in said recess in said base.

* * * * *